United States Patent [19]

Carson

[11] 4,431,529

[45] Feb. 14, 1984

[54] POWER RECOVERY IN GAS CONCENTRATION UNITS

[75] Inventor: Don B. Carson, Mt. Prospect, Ill.

[73] Assignee: UOP Inc., Des Plaines, Ill.

[21] Appl. No.: 429,885

[22] Filed: Sep. 30, 1982

[51] Int. Cl.[3] ..... C10G 5/04

[52] U.S. Cl. ..... 208/343; 208/341; 208/101; 208/113; 502/34

[58] Field of Search ..... 208/101, 113, 341, 343, 208/342, 346

[56] References Cited

U.S. PATENT DOCUMENTS

| | | | |
|---|---|---|---|
| 2,157,343 | 5/1939 | Mateer et al. | 208/343 |
| 2,710,278 | 6/1955 | Gilmore | 208/341 |
| 2,748,180 | 5/1956 | Webber | 208/341 |
| 2,939,834 | 6/1960 | Evans | 208/101 |
| 3,076,769 | 2/1963 | Pfeiffer | 208/113 |
| 3,122,496 | 2/1964 | Harper | 208/101 |
| 3,131,228 | 4/1964 | Moon | 208/341 |
| 3,200,066 | 8/1965 | Scoggin | 208/342 |
| 3,247,129 | 4/1966 | Roelofsen et al. | 252/417 |
| 3,401,124 | 9/1968 | Goulden | 252/417 |
| 3,470,084 | 9/1969 | Scott | 208/101 |
| 3,532,620 | 10/1970 | Asmus et al. | 208/113 |
| 3,537,978 | 11/1970 | Borst, Jr. | 208/341 |
| 3,702,308 | 11/1972 | Bauer et al. | 208/113 X |

FOREIGN PATENT DOCUMENTS

| | | | |
|---|---|---|---|
| 645372 | 7/1962 | Canada | 208/341 |

OTHER PUBLICATIONS

Petroleum Refinery Engineering, 4th Ed., W. L. Nelson, McGraw-Hill Book Co., 1958, pp. 801–804 and 828–830.

The Oil and Gas Journal, Nov. 29, 1951, pp. 84–96, "Modern Trends in Refinery-Gas Extraction Plants" by F. C. Gilmore & R. D. Bauer.

*Primary Examiner*—Delbert E. Gantz
*Assistant Examiner*—Glenn A. Caldarola
*Attorney, Agent, or Firm*—James R. Hoatson, Jr.; John F. Spears, Jr.; William H. Page, II

[57] ABSTRACT

An absorption process is disclosed for the recovery of normally liquid hydrocarbons from a gas stream. The process is useful in recovering hydrocarbons from the gas stream discharged by the main fractionation column of a fluidized catalytic cracking unit. The feed gas is compressed and passed through an absorption zone to produce a high pressure lean gas which is depressurized in a power recovery turbine. The turbine compresses air used within the catalyst regeneration zone of the fluidized catalytic cracking unit.

11 Claims, 1 Drawing Figure

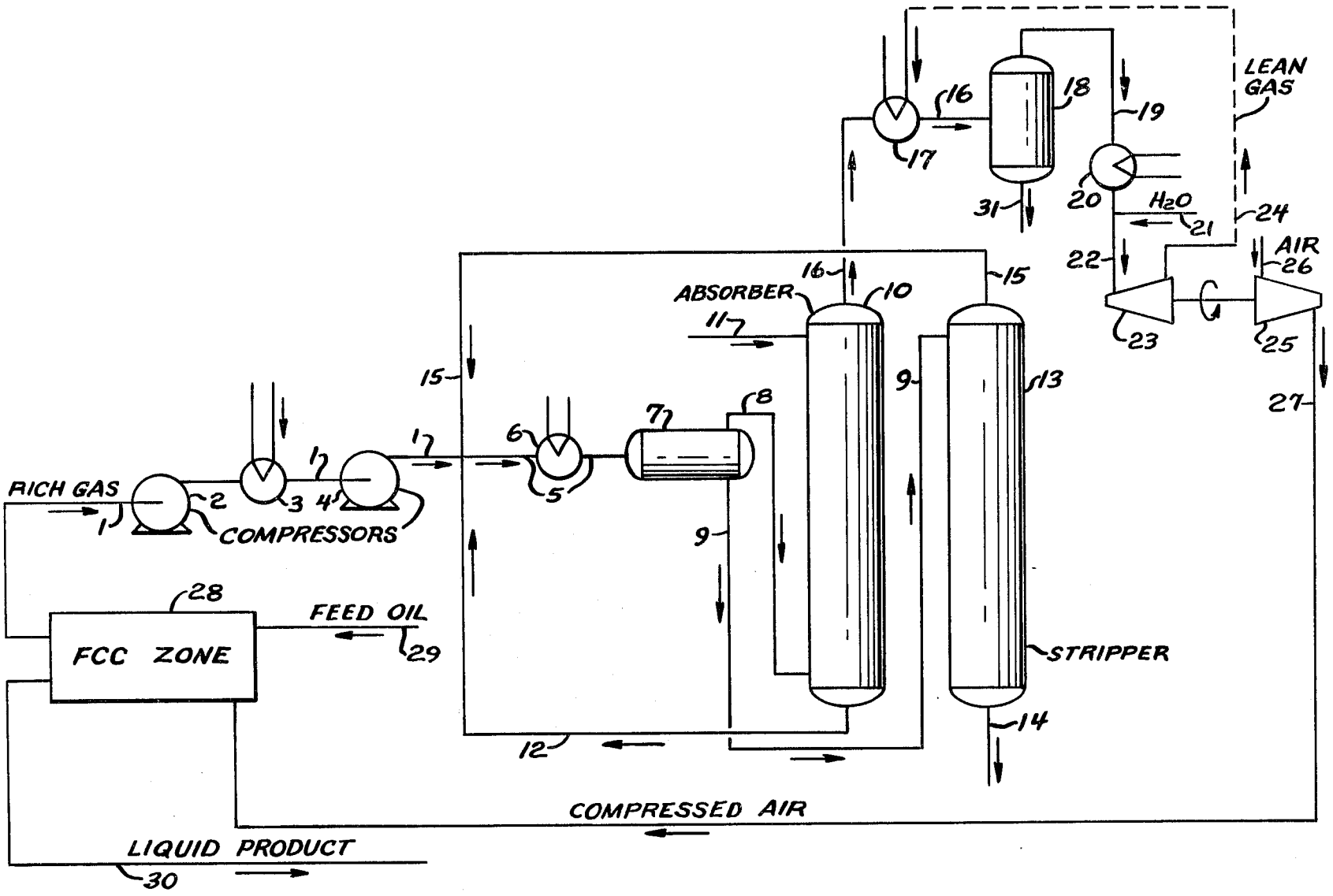
LEAN GAS
AIR
$H_2O$
STRIPPER
ABSORBER
COMPRESSED AIR
COMPRESSORS
FEED OIL
FCC ZONE
RICH GAS
LIQUID PRODUCT

POWER RECOVERY IN GAS CONCENTRATION UNITS

FIELD OF THE INVENTION

The invention relates to the recovery of useful energy from a pressurized gas stream produced in a hydrocarbon conversion process. The invention more specifically relates to a process for recovering normally liquid hydrocarbons from a low pressure gas stream produced in a fluidized hydrocarbon conversion process. The invention is specifically directed to a fluidized catalytic cracking process in which energy is recovered in the gas concentration facilities used to recover gasoline boiling range hydrocarbons from a gas stream, with this energy being used to reduce the utilities cost of operating the cracking process.

PRIOR ART

Fluidized hydrocarbon conversion processes are in widespread commercial use and have been very thoroughly studied. A fluidized catalytic cracking (FCC) process and a light hydrocarbon product recovery plant (gas concentration unit) for use on this process are described at pages 801–804 and 828–830 of *Petroleum Refinery Engineering,* 4th Ed., W. L. Nelson, McGraw-Hill Book Co., 1958. A more detailed description of refinery gas recovery units is provided in the article starting at page 84 of the Nov. 29, 1951 *Oil and Gas Journal.* Various arrangements of FCC gas recovery units are shown in U.S. Pat. Nos. 2,939,834; 3,122,496 and 3,470,084. These references show the steps of pressurizing the "wet" gas stream removed from the overhead receiver of the FCC main fractionator and contacting the compressed gas with a lean oil(s) in one or more absorption zones. The lean gas produced in this manner is typically shown as being directed to the refinery fuel or flare system with no attempt being made to recover energy from this gas stream.

A stream of the catalyst employed in an FCC unit is continuously passed into a regeneration zone. The used catalyst is fluidized in the regeneration zone by compressed air, and carbonaceous deposits present on the catalyst are combusted thereby producing a stream of hot pressurized flue gas. A common practice in the petroleum refining industry is the recovery of useful energy from this flue gas stream by depressurizing it in a power recovery turbine. The recovered energy may be used to generate electricity or to compress air which is then passed into the regeneration zone. These practices are shown in U.S. Pat. Nos. 3,247,129 and 3,401,124.

BRIEF SUMMARY OF THE INVENTION

The invention provides a more energy-efficient process for operating the gas concentration unit of a fluidized hydrocarbon conversion process. A broad embodiment of the invention may be characterized as a process for the recovery of normally liquid hydrocarbons which comprises the steps of compressing a feed gas stream produced in a fluidized hydrocarbon conversion process and which comprises a mixture of normally liquid hydrocarbons and normally gaseous hydrocarbons having less than four carbon atoms per molecule to a pressure above about 200 psig; contacting the feed gas stream with an absorbent liquid and transferring normally liquid hydrocarbons from the feed gas stream to the absorbent liquid and thereby forming a lean gas stream; depressurizing the lean gas stream to a pressure below about 60 psig through a power recovery turbine and recovering useful energy from the lean gas stream; and compressing air used within the fluidized hydrocarbon conversion process through the use of the recovered energy. In more limited embodiments, the lean gas stream is heated and possibly supplemented by water vapor to increase the amount of energy recoverable in the expansion turbine. In another embodiment, the depressurized lean gas stream is used to cool the undepressurized lean gas stream thereby condensing normally liquid hydrocarbons.

DESCRIPTION OF THE DRAWING

The Drawing is a simplified diagram illustrating several different embodiments of the subject invention.

Referring now to the Drawing, the feed gas stream, comprising a rich gas removed from the main fractionation column of an FCC process zone 28, passing through line 1 is compressed in the compressor 2. The feed stream is cooled in the interstage cooler 3 by indirect heat exchange and is then further pressurized in the compressor 4. The feed gas stream is then combined with the hereinafter characterized vapor stream carried by line 15 and liquid stream carried by line 12. The resultant admixture flows through line 5 and is further cooled in indirect heat exchange means 6 prior to entering the vapor-liquid separation zone 7. The liquid entering in the vapor-liquid separation zone is withdrawn through line 9 and passed into an upper point of a stripper column 13 as the feed stream to the stripper. The stripper, which is reboiled by a means not shown, separates the entering liquid hydrocarbon into a net bottoms stream removed through line 14 and an overhead vapor stream removed through line 15. The bottoms stream contains the lean oil fed to the process and the hydrocarbons recovered in the process and is passed to the appropriate collection or separation facilities.

The uncondensed and unabsorbed hydrocarbons which enter the vapor-liquid separation zone 7 are removed as a vapor phase stream carried by line 8 and fed to a bottom point of the absorber 10. These gases pass upward countercurrent to a descending stream of absorbent liquid fed to an upper point of the absorber through line 11. This countercurrent contacting, which is performed at absorption-promoting conditions, results in the transfer of a very high percentage of the normally liquid hydrocarbons and possibly lighter hydrocarbons such as propane into the absorbent liquid. This produces a bottoms stream removed in line 12 which comprises the entering absorbent liquid plus the hydrocarbons which this liquid has removed from the vapor stream. The unabsorbed vapors exit the absorber 10 as a lean gas stream carried by line 16 which is at the elevated pressure at which the absorber is operated.

The lean gas stream is first cooled by indirect heat exchange in the cooler 17 and is then passed into a second vapor-liquid separation zone 18. Cooling this stream effects the condensation of vaporized absorbent liquid, with the resultant liquid phase material being collected and withdrawn through line 31. The remaining uncondensed portion of the lean gas stream continues through line 19 and may be heated in an indirect heat exchange means 20. If the lean gas stream is at a sufficiently high temperature at this point, an optional stream of liquid phase water carried by line 21 may be admixed with the lean gas stream to increase its volume by the vaporization of the water and the production of a pressurized steam-hydrocarbon gas mixture. The pressurized gas flowing through line 22 is directed into the inlet of a power recovery turbine 23 and is therein depressurized to yield the relatively low pressure lean gas stream carried by line 24. This gas stream may be disposed of as by passage into the refinery fuel gas collection header or by passage to other hydrocarbon recovery facilities.

The energy recovered by the depressurization of the lean gas stream is transferred through a shaft to a compressor 25 wherein air from line 26 is pressurized to form the relatively high pressure air stream carried by line 27. The compressed air stream may then be passed into the FCC unit in which the feed gas stream originated to aid in the regeneration, transportation or cooling of the catalyst used in the process. The compressed air carried by line 27 is passed into the catalyst regeneration zone of the fluidized catalytic cracking (FCC) zone 28. The air is used to regenerate catalyst used in the conversion of residual oils entering via line 29 into liquid products removed through line 30, and other lines not shown, and vaporous products forming the wet gas feed stream transported by line 1 into the gas concentration unit.

In a limited and optional embodiment of the invention, the lean gas stream carried by line 24, which has been cooled due to expansion, is caused to flow to the indirect heat exchange means 17 as the coolant used therein. It is to be noted that the Drawing illustrates several embodiments of the inventive concept, and that it is unlikely that all of these embodiments would be practiced simultaneously. More specifically, if the depressurized lean gas is utilized to cool the undepressurized lean gas in the heat exchanger 17, then it is preferred that the gas flowing through line 19 is not heated as by the optional heater 20 or supplemented with water from line 21.

DETAILED DESCRIPTION

Most large petroleum refineries contain a hydrocarbon conversion process referred to as a fluidized catalytic cracking (FCC) process unit. In this unit the residual petroleum stream such as a vacuum gas oil or reduced crude is brought into contact with fluidized cracking catalyst at a substantially elevated temperature and normally in the absence of added hydrogen. This contacting results in a reduction in the average molecular weight of the feed hydrocarbon thereby producing a large variety of product hydrocarbons ranging from methane to hydrocarbons very similar in boiling point and volatility to the heavier feed hydrocarbons. The product hydrocarbons are separated from the catalyst and withdrawn from the reaction zone of the FCC unit. Typically this stream, after cooling by indirect heat exchange, is passed into an intermediate point of a fractionation column referred to as a main fractionation column or main column of the FCC process. The product hydrocarbons are therein separated into a number of effluent streams having separate boiling point ranges. For example, the heavier product hydrocarbons may be separated into such product streams as gas oil, diesel fuel and naphtha. There is also produced a vaporous effluent stream which is withdrawn from the overhead receiver of the main fractionation column. This gas stream, which is the preferred feed gas stream of the subject process, is referred to as a rich gas or "wet" gas since it contains substantial quantities of normally liquid hydrocarbon and various olefinic hydrocarbons which may be recovered. As used herein, the term "normally liquid hydrocarbons" is intended to indicate hydrocarbons which are liquid at 60° F. and a pressure of one atmosphere absolute. The olefinic hydrocarbons have substantial economic value as feedstock for alkylation, polymerization or catalytic condensation processes and it is therefore very desirable to recover the olefinic hydrocarbons and the normally liquid hydrocarbons present in the wet gas stream. For this reason, the wet gas stream is normally passed into a collection facility referred to as a gas concentration unit.

In a gas concentration unit, the feed gas is normally first compressed as to a pressure above 150 psig and is then contacted with one or more absorbent streams at absorption-promoting conditions. Typical configurations of the gas concentration units may be seen from the previously cited references. In many of these configurations, a gas stream is admixed with recycled vapor and liquid streams and then passed into a high pressure separator as the first contacting step. The vapor stream removed from the high pressure separator is then passed into a first or primary absorber wherein the gases are normally contacted with one or more naphtha streams. The vaporous material which is not absorbed into these naphtha streams is removed from the top of the primary absorber and typically passed into a second or sponge absorber. The lean absorption liquid utilized in the sponge absorber is typically a higher boiling material such as a gas oil or fuel oil with this contacting serving to remove most of the naphtha which is present in the gas stream due to its contact with the lean naphtha stream in the primary absorption column. The heavy oil may also effect some absorption of lighter hydrocarbons and therefore function as a third absorption sequence. The removal of the heavier hydrocarbons, normally including most of the $C_4$-plus or $C_3$-plus hydrocarbons, produces a lean gas stream composed mostly of methane, ethane and ethylene. Heretofore it has been a customary practice to depressurize the thus-created lean gas stream into a low pressure fuel gas receiving system through a control valve. Typically the lean gas was directed to the fuel gas header system of the refinery which is normally maintained at a pressure in the range of from about 20 to about 50 psig.

It is an objective of the subject invention to provide a more energy-efficient gas concentration unit for use in conjunction with FCC units. It is a further objective of the subject invention to provide a gas concentration process in which useful energy is recovered from the lean gas stream discharged from the absorber of a gas concentration process. A further objective of the subject invention is to eliminate the requirement for a sponge absorber in a gas concentration unit by removing naphtha boiling range components from the lean gas of the primary absorber through an economical condensation method.

In the subject invention, the pressurized lean gas stream removed from the primary or a sponge absorber is depressurized in a power recovery turbine. This turbine may be of conventional design of the centrifugal or axial flow type. To maximize the recovery of energy from the lean gas stream, it is preferred that the power recovery turbine is directly mechanically coupled to a device which utilizes the recovered energy. It is specifically preferred that the power recovery turbine is connected through a shaft, possibly with required gear trains, to a centrifugal air compressor. The energy which may be recovered in this manner is basically dependent on the pressure of the lean gas stream as it is delivered to the power recovery turbine, the composition of the lean gas stream, the temperature of the lean gas stream and the pressure to which the lean gas stream may be depressurized in the power recovery turbine. This exit pressure of the power recovery turbine will normally be that pressure at which the gas will flow into its receiving system, which is still preferably the fuel gas header system of the refinery. The lean gas stream will therefore normally be depressurized to a pressure in the range of from about 20 to about 50 psig in the power recovery turbine.

The composition, temperature and pressure of the lean gas stream is basically dependent on the operating conditions of the absorption operations performed in the gas concentration unit. These absorption or contacting steps will be performed at absorption-promoting conditions which typically include a temperature in the range of from about 50° to about 125° F. and an elevated pressure. Although older gas concentration units may be operated at somewhat reduced pressures, it is preferred that the subject process is used on a gas concentration unit in which the feed or wet gas stream is compressed to at least 200 psig. As used herein, absorption-promoting conditions therefore include a pressure above 200 psig. Since the power which may be recovered in the lean gas stream is increased with the pressure of the lean gas stream, the use of higher pressures is preferred. It is therefore preferred to compress the feed gas stream to a pressure above 225 psig and more preferably above 275 psig prior to contact with the absorbent liquids. Since energy is recovered from the pressurized lean gas stream, it is more economical to operate the absorption section of the gas concentration unit at a higher pressure and the compression of the feed gas stream to a pressure above 350 psig is therefore preferred if this operating pressure is acceptable.

The energy which is recovered by depressurizing the lean gas stream may be utilized to drive many types of mechanical apparatus including pumps, electrical generators and compressors which deliver pressurized streams of hydrocarbon, hydrogen, or inert gases, with these various gases thereby being pressurized for transportation, initial charging to a hydrocarbon conversion process or for recycling within a hydrocarbon conversion process. As previously stated, it is highly preferred that the energy recovered by depressurizing the lean gas stream is utilized to directly compress air which is then used within a fluidized hydrocarbon conversion process. Particularly the air is preferably used within the catalyst regeneration section of an FCC unit. The air may be thus fed into the catalyst regeneration zone directly to provide all or a portion of the air which is utilized in the combustion of carbonaceous deposits which form on the catalyst during use and which are removed by combustion in a separate catalyst regeneration zone in a manner well known to those familiar with petroleum refining arts. The compressed air delivered by the subject process may also be utilized in a different manner within the FCC unit if so desired. For instance the air could be utilized in a catalyst cooler, which typically operates at a higher pressure than the catalyst regeneration zone and therefore requires a higher pressure air stream. The use of the air compressed by the subject method in the catalyst coolers is therefore highly preferred since the subject process is capable of delivering air at higher pressures than the air normally supplied by the power recovery turbines driven by the flue gas stream of the catalyst regeneration zone. The pressurized air stream of the subject process should be above 50 psig and is preferably at a pressure above 85 psig.

The subject invention may be accordingly characterized as a process for recovering gasoline boiling range hydrocarbons from a wet gas stream of a fluidized catalytic cracking process which comprises the steps of compressing the wet gas stream, which comprises methane, ethane and hydrocarbons having boiling points between 250° and 400° F. and which is produced in a fluidized catalytic cracking process, to a pressure above about 225 psig; passing the thus-compressed wet gas stream into an absorption zone wherein the wet gas stream is contacted with one or more absorption liquids at absorption-promoting conditions and thereby forming a lean gas stream; depressurizing the lean gas stream to a pressure below about 60 psig through a power recovery turbine which is mechanically linked to an air compressor in which a pressurized air stream is produced, thereby producing a pressurized air stream and a low pressure gas stream; and utilizing the pressurized air stream in the catalyst regeneration zone of the fluidized catalytic cracking process.

There are two different mechanisms for increasing the effectiveness of utilizing the subject process. The first of these mechanisms is to increase the useful energy which is recovered in the power recovery turbine by increasing the temperature or quantity or both the temperature and quantity of the gas stream which is depressurized in the turbine. The lean gas stream as it emanates from the absorption column is normally at a relatively low temperature below about 150° F. It may therefore be readily heated by indirect heat exchange against a large number of streams which are available in a typical petroleum refiner. The lean gas stream may therefore be heated by indirect heat exchange against the effluent streams of fractionation columns, recycle streams and various process and reaction zone effluent streams. It is especially preferred that if feasible the pressurized lean gas stream is heated by indirect heat exchange against a process stream within the gas concentration unit and most particularly for the purpose of cooling a stream which has just been compressed. The unexpanded lean gas stream may therefore be used to provide the interstage cooling normally employed between the compressors utilized in the initial pressurization of the feed gas stream. The indirect heat exchange means 20 of the Drawing may therefore be indirect heat exchange means 3 used as an interstage cooler.

An increase in the temperature in the lean gas stream allows a greater amount of energy to be recovered during the depressurization and may also be useful in preventing the condensation of the less volatile chemical compounds remaining in the lean gas stream during or immediately after the depressurization. Heating the undepressurized lean gas stream may therefore be advisable to avoid condensation with the power recovery turbine. The energy which is recovered in the power recovery turbine may also be increased by supplementing the lean gas stream with water or some other readily vaporizable compound. Preferably the addition of this vaporizable compound is performed in conjunction with the heating of the undepressurized lean gas stream such that a portion of the added heat is utilized to vaporize the added liquid. This sequence of additional and optional steps results in an increased quantity of high pressure vapor which can be depressurized in the power recovery turbine, thereby increasing the amount of energy delivered by the turbine.

The second mechanism for increasing the effectiveness of the subject process involves a recognition that the depressurized lean gas stream will be at a substantially lower temperature than the material entering the power recovery turbine. The relatively cool effluent of the power recovery turbine may therefore be utilized as a refrigerant within the gas concentration process. That is, the depressurized lean gas stream may be used to cool various streams within the gas concentration unit. It may be used to provide interstage cooling between compressors, to remove the heat of absorption liberated in the absorber, or as is preferred to cool the undepressurized lean gas stream in an autorefrigeration mode of operation shown by line 24 passing the cool low pressure gas stream into exchanger 17.

Cooling the undepressurized lean gas stream will result in the condensation of the least volatile hydrocarbons contained therein, which will normally be naphtha boiling range hydrocarbons which were originally part of the absorbent liquid. These hydrocarbons enter the lean gas stream in a quantity dependent on the equilibrium concentration of these compounds in the gas stream at the conditions which are present at the top of the absorption zone and the approach to equilibrium which is achieved at this point. Sufficient cooling by autorefrigeration will remove the desired amount of the naphtha boiling range compounds from the undepressurized lean gas stream to render it unnecessary to employ a sponge absorber. This eliminates the capital requirements of providing the sponge absorber and the utilities cost of circulating the sponge oil to the absorber. It should be noted that in the autorefrigeration mode of operation, it will normally not be desired to increase the temperature of the undepressurized lean gas stream in the manner previously described since this will increase the temperature of the depressurized lean gas stream and lessen the amount of refrigeration which is achieved. Therefore the two mechanisms set out above for increasing the effectiveness and advantages of utilizing the subject process will normally be mutually exclusive of each other.

I claim as my invention:

1. A process for the recovery of normally liquid hydrocarbons from a gas stream produced in a fluidized hydrocarbon conversion process which comprises the steps of:

(a) compressing a feed gas stream produced in a fluidized hydrocarbon conversion process and which comprises a mixture of normally liquid hydrocarbons and normally gaseous hydrocarbons having less than four carbon atoms per molecule to a pressure above about 200 psig;

(b) contacting the feed gas stream with an absorbent liquid under absorption-promoting conditions and transferring normally liquid hydrocarbons from the feed gas stream to the absorbent liquid and thereby forming a lean gas stream;

(c) depressurizing the lean gas stream to a pressure below about 60 psig through a power recovery turbine and recovering useful energy from the lean gas stream; and, (d) compressing air used within the fluidized hydrocarbon conversion process through the use of the recovered energy.

2. The process of claim 1 further characterized in that the lean gas stream is heated prior to being depressurized.

3. The process of claim 2 further characterized in that the lean gas stream is heated by indirect heat exchange against the feed gas stream after the feed gas stream has been at least partially compressed to said pressure above about 200 psig.

4. The process of claim 2 further characterized in that liquid water is admixed into the lean gas stream and vaporized prior to the depressurization of the lean gas stream.

5. The process of claim 2 further characterized in that the feed gas stream is produced in a fluidized catalytic cracking process and comprises methane, ethane and hydrocarbons having boiling points between 250° and 400° F.

6. The process of claim 5 further characterized in that the air compressed through the use of the recovered energy is passed into the regeneration zone of the fluidized catalytic cracking process.

7. A process for recovering gasoline boiling range hydrocarbons from the wet gas stream of a fluidized catalytic cracking process which comprises the steps of:

(a) compressing a wet gas stream of a fluidized catalytic cracking process to a pressure above about 225 psig;

(b) passing the wet gas stream into an absorption zone wherein the wet gas stream is contacted with an absorption liquid at absorption-promoting conditions and thereby forming a lean gas stream;

(c) depressurizing the lean gas stream to a pressure below about 60 psig through a power recovery turbine which is mechanically linked to an air compressor in which a pressurized air stream is produced, thereby producing a pressurized air stream and a low pressure gas stream; and, (d) utilizing the pressurized air stream in the catalyst regeneration zone of the fluidized catalytic cracking process.

8. The process of claim 7 further characterized in that the lean gas stream is heated by indirect heat exchange prior to being depressurized.

9. The process of claim 8 further characterized in that the lean gas stream is heated by heat exchange against the wet gas stream.

10. The process of claim 7 further characterized in that the lean gas stream is cooled prior to being depressurized by indirect heat exchange against said low pressure gas stream, thereby causing the condensation of normally liquid hydrocarbons which are separated from the lean gas stream prior to depressurization.

11. The process of claim 10 further characterized in that the wet gas stream is compressed to a pressure above about 275 psig.

* * * * *